US009639037B2

(12) United States Patent
Sato

(10) Patent No.: US 9,639,037 B2
(45) Date of Patent: May 2, 2017

(54) IMAGE FORMING APPARATUS IN WHICH FIXING IS LIMITED TO TEMPERATURES OF A PREDETERMINED RANGE

(71) Applicant: KONICA MINOLTA INC., Chiyoda-ku, Tokyo (JP)

(72) Inventor: Taku Sato, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/558,250

(22) Filed: Dec. 2, 2014

(65) Prior Publication Data

US 2015/0168887 A1 Jun. 18, 2015

(30) Foreign Application Priority Data

Dec. 13, 2013 (JP) ..... 2013-258335

(51) Int. Cl.
*G03G 15/20* (2006.01)

(52) U.S. Cl.
CPC ..... *G03G 15/2039* (2013.01); *G03G 15/205* (2013.01)

(58) Field of Classification Search
CPC ..... G03G 15/5039; G03G 15/2078; G03G 15/5062; G03G 15/205; G03G 15/2039; G03G 15/2028; G03G 2215/00599
USPC ..... 399/69, 33, 49, 70
See application file for complete search history.

(56) References Cited

U.S. PATENT DOCUMENTS 7,113,719 B2 9/2006 Kubota
2009/0196644 A1* 8/2009 Funatsu ..... G03G 15/5062 399/69
2011/0286756 A1* 11/2011 Nishikata ..... G03G 15/2039 399/45

(Continued)

FOREIGN PATENT DOCUMENTS

JP 03015865 A 1/1991
JP 11125987 A 5/1999

(Continued)

OTHER PUBLICATIONS

Japanese Office Action (and English translation thereof) dated Nov. 17, 2015, issued in counterpart Japanese Application No. 2013-258335.

*Primary Examiner* — Walter L Lindsay, Jr.
*Assistant Examiner* — Jessica L Eley
(74) *Attorney, Agent, or Firm* — Holtz, Holtz & Volek PC

(57) ABSTRACT

An image forming apparatus includes: an image forming unit configured to form a toner image on a paper sheet; a fixing unit configured to fix the toner image onto the paper sheet; a fixing temperature detecting unit configured to detect a fixing temperature in the fixing unit; and a control unit configured to allow a fixing operation in the fixing unit only after the fixing temperature is adjusted to be within a predetermined allowable fixing temperature range, when the fixing temperature is outside the allowable fixing temperature range, wherein the control unit sets the allowable fixing temperature range in accordance with fixing properties required in an output of a pattern image for adjustment in an adjustment mode in which various kinds of adjustments related to image formation can be performed based on an output of the pattern image for adjustment.

5 Claims, 11 Drawing Sheets

(56) References Cited

U.S. PATENT DOCUMENTS

| | | | | |
|---|---|---|---|---|
| 2011/0286758 | A1* | 11/2011 | Yoshinaga | G03G 15/2039 399/69 |
| 2013/0004193 | A1* | 1/2013 | Park | G03G 15/2028 399/69 |
| 2013/0101303 | A1* | 4/2013 | Kasai | G03G 15/205 399/45 |
| 2013/0279932 | A1* | 10/2013 | Ishigai | G03G 15/2039 399/69 |
| 2013/0322906 | A1* | 12/2013 | Takatsuka | G03G 15/2039 399/69 |

FOREIGN PATENT DOCUMENTS

| | | | |
|---|---|---|---|
| JP | 2003066765 | A | 3/2003 |
| JP | 2003186346 | A | 7/2003 |
| JP | 2004145086 | A | 5/2004 |
| JP | 2005156624 | A | 6/2005 |

* cited by examiner

IMAGE FORMING APPARATUS IN WHICH FIXING IS LIMITED TO TEMPERATURES OF A PREDETERMINED RANGE

The entire disclosure of Japanese Patent Application No. 2013-258335 filed on Dec. 13, 2013 including description, claims, drawings, and abstract are incorporated herein by reference in its entirety.

BACKGROUND OF THE INVENTION

Field of the Invention

The present invention relates to an electrophotographic image forming apparatus that includes a fixing device.

Description of the Related Art

In an image forming apparatus (such as a printer, a copying machine, or a facsimile machine) using an electrophotographic process technology, an electrostatic latent image is normally formed on the surface of a photoreceptor (a photosensitive drum, for example) when the photoreceptor that is uniformly charged is illuminated with (exposed to) laser light based on image data. Toner is then applied onto the photoreceptor having the electrostatic latent image formed thereon, so that the electrostatic latent image is visualized to forma toner image. After transferred directly onto a paper sheet or indirectly onto a paper sheet via an intermediate transfer member, this toner image is heated and pressed by a fixing device, to form an image on the paper sheet.

The fixing device includes an upper fixing unit that has a fixing surface side member placed on the image formation side (the side on which a toner image is formed) of a paper sheet, a lower fixing unit that has a back surface side supporting member placed on the back surface side (the opposite side from the fixing surface) of the paper sheet, a heat source, and the like. As the back surface side supporting member is pressed against the fixing surface side member, a fixing nip for nipping and conveying a paper sheet is formed.

In the fixing device, the surface temperature (hereinafter referred to as the "fixing temperature") of the fixing surface side member is controlled so as to supply a predetermined amount of heat to a paper sheet. Specifically, as shown in FIG. 1, outputs of the heat source are controlled so that the fixing temperature is maintained within a predetermined allowable fixing temperature range (from a target fixing temperature to the temperature 8° C. higher than the target fixing temperature). The target fixing temperature is an index for controlling outputs of the heat source. When the image forming apparatus is on, or when the operation mode is switched from a power saving mode, or when paper types to be used in image formation are changed, or the like, a warming-up operation for the fixing device (hereinafter referred to as the "warming-up for fixing") is performed in accordance with the set allowable fixing temperature range if the current fixing temperature is outside the allowable fixing temperature range.

The allowable fixing temperature range is set so that neither low-temperature offsetting nor high-temperature offsetting will occur. Low-temperature offsetting is adherence of toner to the fixing surface side member due to insufficient adhesion between the toner and the paper sheet in a case where the toner does not melt well due to a shortage of heat. High-temperature offsetting is adherence of a broken toner layer to the fixing surface side member due to a decrease in cohesive force of the toner in a case where the viscosity of the toner becomes too low due to heating. As shown in FIG. 2, a fixing allowing range is from the temperature at which low-temperature offsetting occurs to the temperature at which high-temperature offsetting occurs. However, the temperature that is higher than the low-temperature offsetting temperature by a predetermined margin (10° C., for example) is normally set as the lower limit of the allowable fixing temperature range, and the temperature that is lower than the high-temperature offsetting temperature by a predetermined margin (10° C., for example) is normally set as the upper limit of the allowable fixing temperature range. The amount of heat required for fixing varies with types, basis weights, and the like of paper sheets, and therefore, the allowable fixing temperature range also varies with types, basis weights, and the like of paper sheets.

So as to increase productivity, the warming-up for fixing is preferably completed in a short period of time. In view of this, there is a suggested image forming apparatus that sets a lower or higher fixing speed (the speed of conveyance of paper sheets passing through the fixing device) than the fixing speed for regular image formation, to make the allowable fixing temperature range wider than that for regular image formation and shorten the warming-up time before fixing (JP 2004-145086 A and JP 2003-66765 A, for example). There is also a suggested image forming apparatus that makes the allowable fixing temperature range wider than that for regular image formation and shortens the warming-up time before fixing in a case where image formation is performed on a small number of paper sheets or where images that require a small amount of toner are formed (JP 2003-186346 A and JP 11-125987 A, for example).

Meanwhile, an image forming apparatus has various kinds of adjustment modes for adjusting positions, densities, and the like of images to be output. In an adjustment mode, various kinds of adjustments are performed based on an output of a pattern image for adjustment. Therefore, if the fixing temperature is outside the allowable fixing temperature range, the warming-up for fixing is performed in the same manner as the warming-up for fixing performed at a start of regular image formation. The allowable fixing temperature range for adjustment is normally the same as the allowable fixing temperature range for regular image formation.

In such an adjustment mode, the warming-up time before fixing can be shortened by using a technology disclosed in one of the above mentioned literatures, which are JP 2004-145086 A, JP 2003-66765 A, JP 2003-186346 A, and JP 11-125987 A. However, the allowable fixing temperature range is set so that image fixing properties can be secured or the fixing properties will become 100%. Therefore, the allowable fixing temperature range is not dramatically extended, and the effect to shorten the warming-up time is limited.

SUMMARY OF THE INVENTION

An object of the present invention is to provide an image forming apparatus that can shorten the warming-up time before fixing in an adjustment mode, and improve adjustment efficiency.

To achieve at least one of the abovementioned objects, according to an aspect, an image forming apparatus reflecting one aspect of the present invention comprises: an image forming unit that forms a toner image on a paper sheet; a fixing unit that fixes the toner image onto the paper sheet; a fixing temperature detecting unit that detects a fixing temperature in the fixing unit; and a control unit that allows a fixing operation in the fixing unit only after the fixing temperature is adjusted to be within a predetermined allowable fixing temperature range in a case where the fixing temperature is outside the allowable fixing temperature range, wherein the control unit sets the allowable fixing temperature range in accordance with the fixing properties required in an output of a pattern image for adjustment in an adjustment mode in which various kinds of adjustments related to image formation can be performed based on an output of the pattern image for adjustment.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 3:
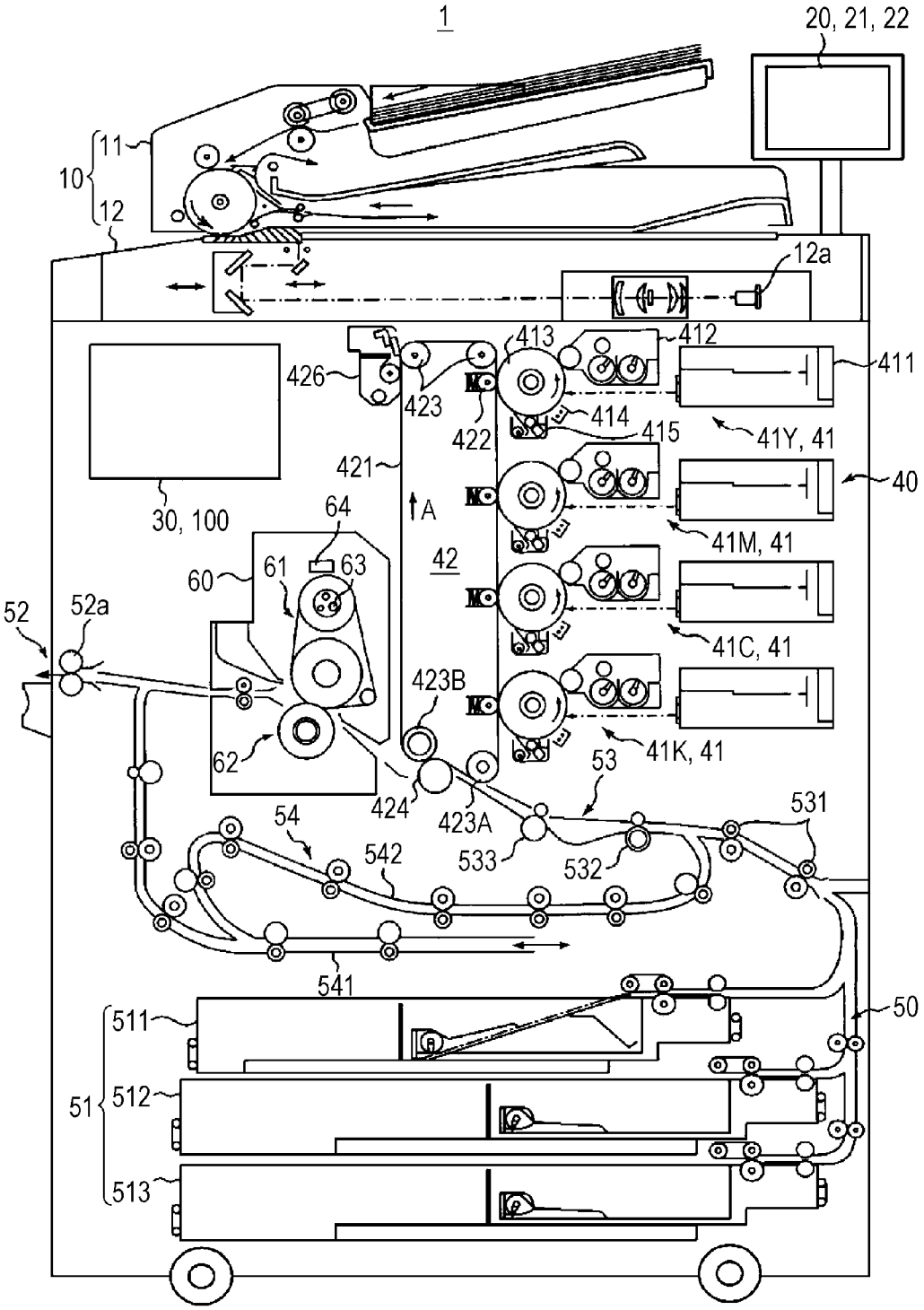
FIG. 3 is a diagram showing the entire structure of an image forming apparatus according to an embodiment of the present invention.
Figure 4:
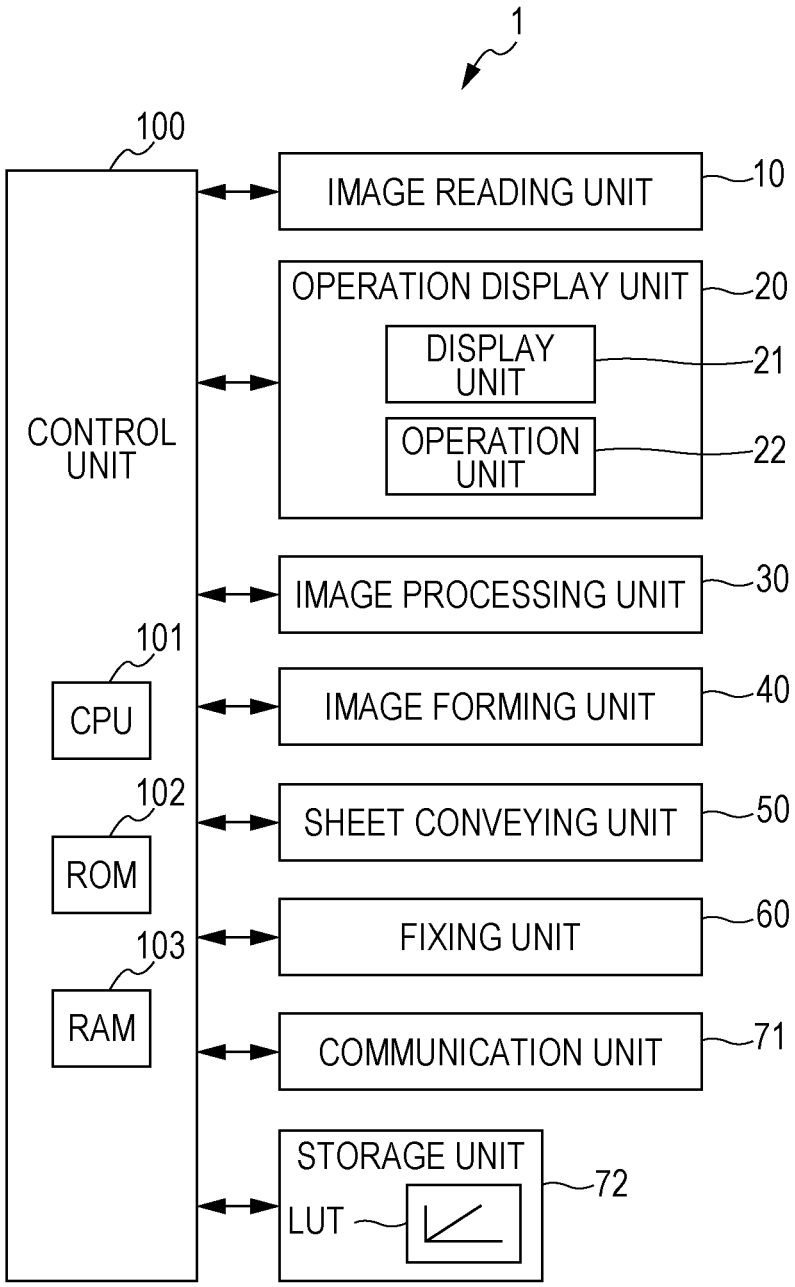
FIG. 4 is a diagram showing the principal components of the control system of the image forming apparatus according to the embodiment.

FIG. 3 is a diagram showing the entire structure of an image forming apparatus 1 according to an embodiment of the present invention. FIG. 4 is a diagram showing the principal components of the control system of the image forming apparatus 1 according to the embodiment.

The image forming apparatus 1 shown in FIGS. 3 and 4 is a color image forming apparatus of an intermediate transfer type using an electrophotographic process technology. In the image forming apparatus 1, a vertical tandem system is employed so that photosensitive drums 413 corresponding to the four colors of CMYK are arranged in series in the conveying direction of an intermediate transfer belt 421 (the vertical direction), and toner images of the respective colors are transferred onto the intermediate transfer belt 421 by one operation.

Specifically, the image forming apparatus 1 performs a primary transfer of toner images of the respective colors of Y (yellow), M (magenta), C (cyan), and K (black) from the photosensitive drum 413 onto the intermediate transfer belt 421, and overlaps the toner images of the four colors on one another on the intermediate transfer belt 421. After that, the image forming apparatus 1 performs a secondary transfer of the toner images onto a paper sheet, to form an image.

As shown in FIGS. 3 and 4, the image forming apparatus 1 includes an image reading unit 10, an operation display unit 20, an image processing unit 30, an image forming unit 40, a sheet conveying unit 50, a fixing unit 60, and a control unit 100.

The control unit 100 includes a CPU (Central Processing Unit) 101, a ROM (Read Only Memory) 102, and a RAM (Random Access Memory)103. The CPU 101 reads a program in accordance with the purpose of processing from the ROM 102 or a storage unit 72, and loads the program into the RAM 103. In conjunction with the loaded program, the CPU 101 controls operation of each block of the image forming apparatus 1 in a centralized manner.

The storage unit 72 is formed with a nonvolatile semiconductor memory (a so-called flash memory) or a hard disk drive, for example. The storage unit 72 stores a look-up table LUT that is referred to when operation of each block is controlled, for example.

The control unit 100 performs transmission and reception of various kinds of data to and from an external device (a personal computer, for example) connected to a communication network such as a LAN (Local Area Network) or a WAN (Wide Area Network) via a communication unit 71. The control unit 100 receives image data (input image data) in a page description language (PDL) transmitted from an external device, for example, and performs control to have an image formed on a paper sheet based on the image data. The communication unit 71 includes various kinds of interfaces such as an NIC (Network Interface Card), a MODEM (MOdulator-DEModulator), and a USB (Universal Serial Bus).

The image reading unit 10 includes an automatic document feeding device 11 called an ADF (Auto Document Feeder) and a document image scanning device 12 (a scanner).

The automatic document feeding device 11 conveys a document placed on a document tray with a conveyance mechanism, to send the document to the document image scanning device 12. By virtue of the automatic document feeding device 11, images of a large number of documents placed on the document tray can be consecutively read.

The document image scanning device 12 optically scans a document conveyed onto a contact glass from the automatic document feeding device 11 or a document placed on the contact glass, and forms an image on the light receiving surface of a CCD (Charge Coupled Device) sensor 12*a* with light reflected from the document. In this manner, a document image is read. The image reading unit 10 generates input image data based on the results of reading by the document image scanning device 12. This input image data is subjected to predetermined image processing at the image processing unit 30.

The operation display unit 20 is formed with a liquid crystal display (LCD) having a touch panel, for example, and functions as a display unit 21 and an operation unit 22. The display unit 21 displays various operation screens, conditions of images, operating conditions of respective functions, and the like, in accordance with display control signals that are input from the control unit 100. The operation unit 22 includes various kinds of operation keys such as a numeric keypad and a start key, to receive various input operations from users and output operating signals to the control unit 100.

By operating the operation display unit 20, a user can determine settings related to image formation, such as a document setting, an image quality setting, a magnification setting, an application setting, an output setting, a printing side setting, and a sheet setting. By operating the operation display unit 20, a user can also realize an adjustment mode in which various kinds of adjustments such as a top edge timing adjustment are performed.

The image processing unit 30 includes a circuit or the like that performs digital image processing on input image data in accordance with initial settings or user settings. For example, the image processing unit 30 performs tone correction based on tone correction data (a tone correction table) under the control of the control unit 100 (image density control). The image processing unit 30 also performs various correction processes such as color correction and shading correction, a compression process, and the like, on the input image data. The image forming unit 40 is controlled based on the image data subjected to those processes.

The image forming unit 40 includes image formation units 41 for forming images with the respective single-color toners of the Y component, the M component, the C component, and the K component based on the input image data, and an intermediate transfer unit 42.

The image formation units 41 are formed with four image formation units 41Y, 41M, 41C, and 41K for the Y component, the M component, the C component, and the K component. Since the image formation units 41Y, 41M, 41C, and 41K have the same structures, like structural elements are denoted by like reference numerals for ease of explanation and simplification of illustration in the drawings, and Y, M, C, or K is attached to a reference numeral where there is a need for a distinction. In FIG. 3, only the structural elements of the image formation unit 41Y for the Y component are denoted by reference numerals, and the structural elements of the other image formation units 41M, 41C, and 41K are not.

Each image formation unit 41 includes an exposing device 411, a developing device 412, a photosensitive drum 413, a charging device 414, a drum cleaning device 415, and the like.

The photosensitive drum 413 is an organic photoconductor (OPC) of a negative charge type that is formed by sequentially stacking an undercoat layer (UCL), a charge generation layer (CGL), and a charge transport layer (CTL) on a conductive cylinder made of aluminum (an aluminum tube), for example.

The charge generation layer is formed with an organic semiconductor containing a charge generating material (phthalocyanine pigment, for example) dispersed in a resin binder (polycarbonate, for example), and generates a pair of positive charge and negative charge upon exposure by the exposing device 411. The charge transport layer is formed by dispersing a hole transporting material (an electron donating nitrogen-containing compound) in a resin binder (a polycarbonate resin, for example), and transports the positive charge generated in the charge generation layer to the surface of the charge transport layer.

The charging device 414 is formed with a corona discharger such as a scorotron charger or a corotron charger. The photosensitive drum 413 is uniformly charged by the charging device 414, to have the negative polarity.

The exposing device 411 is formed with a semiconductor laser, for example. The exposing device 411 illuminates the photosensitive drum 413 with laser light in accordance with the images of the respective color components. As the positive charge generated in the charge generation layer of the photosensitive drum 413 is transported to the surface of the charge transport layer, the surface charge (the negative charge) of the photosensitive drum 413 is neutralized. Accordingly, electrostatic latent images of the respective color components are formed on the surface of the photosensitive drum 413 by virtue of a potential difference from the surrounding area.

The developing device 412 houses developers (two-component developers each formed with a toner and magnetic carriers) for the respective color components, and forms a toner image by applying the toners of the respective colors to the surface of the photosensitive drum 413 and visualizing the electrostatic latent images Specifically, a developing bias voltage is applied to the developer carrier (a developing roller), and the charged toners on the developer carrier move onto and adhere to the exposed portion of the surface of the photosensitive drum 413 by virtue of a potential difference between the surface of the photosensitive drum 413 and the developer carrier.

The drum cleaning device 415 includes a drum cleaning blade or the like that is in contact with and slides on the surface of the photosensitive drum 413, and removes untransferred toner remaining on the surface of the photosensitive drum 413 after the primary transfer.

The intermediate transfer unit 42 includes the intermediate transfer belt 421, primary transfer rollers 422, supporting rollers 423, a secondary transfer roller 424, a belt cleaning device 426, and the like.

The intermediate transfer belt 421 is formed with an endless belt, and is stretched in the form of a loop by the supporting rollers 423. At least one of the supporting rollers 423 is a driving roller, and the other ones are following rollers. For example, a supporting roller 423A that is located on the downstream side of the primary transfer roller 422 for the K component in the belt moving direction is preferably the driving roller (hereinafter referred to as the "driving roller 423A"). With this, the moving speed of the belt in the primary transfer unit can be easily maintained at a constant speed. As the driving roller 423A rotates, the intermediate transfer belt 421 moves in the direction indicated by an arrow A at a constant speed.

The primary transfer rollers 422 are placed on the inner circumferential surface side of the intermediate transfer belt 421, facing the photosensitive drums 413 of the respective color components. As the primary transfer rollers 422 are pressed against the photosensitive drums 413 with the intermediate transfer belt 421 interposed in between, primary transfer nips for transferring toner images from the photosensitive drums 413 onto the intermediate transfer belt 421 are formed.

The secondary transfer roller 424 is placed on the outer circumferential surface side of the intermediate transfer belt 421, facing the supporting roller 423B placed on the downstream side of the driving roller 423*a* in the belt moving direction (the supporting roller 423B will be hereinafter referred to as the "backup roller 423B"). As the secondary transfer roller 424 is pressed against the backup roller 423B with the intermediate transfer belt 421 interposed in between, a secondary transfer nip for transferring a toner image from the intermediate transfer belt 421 onto a paper sheet is formed.

When the intermediate transfer belt 421 passes through the primary transfer nips, the toner images on the photosensitive drums 413 are sequentially transferred onto the intermediate transfer belt 421 in an overlapping manner. Specifically, a primary transfer bias is applied to each primary transfer roller 422 to provide the back surface side (the side in contact with the primary transfer rollers 422) of the intermediate transfer belt 421 with charge of the opposite polarity from that of the toner. In this manner, the toner images are electrostatically transferred onto the intermediate transfer belt 421.

When a paper sheet passes through the secondary transfer nip after that, the toner image on the intermediate transfer belt 421 is transferred onto the paper sheet. Specifically, a secondary transfer bias is applied to the secondary transfer roller 424 to provide the back surface side (the side in contact with the secondary transfer roller 424) of the paper sheet with charge of the opposite polarity from that of the toner. In this manner, the toner image is electrostatically transferred onto the paper sheet. The paper sheet having the toner image transferred thereonto is then conveyed toward the fixing unit 60.

The belt cleaning device 426 includes a belt cleaning blade or the like that is in contact with and slides on the surface of the intermediate transfer belt 421, and removes untransferred toner remaining on the surface of the intermediate transfer belt 421 after the secondary transfer.

In the intermediate transfer unit 42, a structure (a so-called belt-type secondary transfer unit) having a secondary transfer belt stretched in the form of a loop by supporting rollers including a secondary transfer roller may be employed in place of the secondary transfer roller 424.

The fixing unit 60 includes an upper fixing unit 61 that has a fixing surface side member placed on the fixing surface side (the side on which a toner image is formed) of a paper sheet, a lower fixing unit 62 that has a back surface side supporting member placed on the back surface side (the opposite side from the fixing surface) of the paper sheet, a heat source 63 that heats the fixing surface side member, a fixing temperature detecting unit 64 that detects a surface temperature of the fixing surface side member, and the like.

A fixing belt serves as the fixing surface side member in a case where the upper fixing unit 61 is of a belt heating type (see FIG. 3), and a fixing roller serves as the fixing surface side member in a case where the upper fixing unit 61 is of a roller heating type. A pressure roller serves as the back surface side supporting member in a case where the lower fixing unit 62 is of a roller pressure type (see FIG. 3), and a pressure belt serves as the back surface side supporting member in a case where the lower fixing unit 62 is of a belt pressure type. As the back surface side supporting member is pressed against the fixing surface side member, a fixing nip for nipping and conveying a paper sheet is formed. A conveyed paper sheet that has a toner image transferred thereonto through a secondary transfer is heated and pressed when passing through the fixing nip. As a result, the toner image is fixed onto the paper sheet. The fixing unit 60 may also include a separating air blowing unit that blows air toward the fixing surface side member or the back surface side supporting member to separate a paper sheet from the fixing surface side member or the back surface side supporting member.

In the fixing unit 60, the surface temperature (the fixing temperature) of the fixing surface side member is controlled so as to supply a predetermined amount of heat to a paper sheet. Specifically, outputs of the heat source 63 are controlled so that the fixing temperature detected by the fixing temperature detecting unit 64 is maintained within a predetermined allowable fixing temperature range. The allowable fixing temperature range is set in accordance with the type and the basis weight of paper.

When the image forming apparatus 1 is on, or when the operation mode is switched from a power saving mode, or when paper types to be used in image formation are changed, or the like, warming-up for fixing is performed in accordance with the set allowable fixing temperature range if the current fixing temperature is outside the allowable fixing temperature range. That is, in a case where the fixing temperature is outside the predetermined allowable fixing temperature range, the control unit 100 allows a fixing operation at the fixing unit 60 only after the fixing temperature is adjusted to be within the allowable fixing temperature range.

Table 1 shows an example of the allowable fixing temperature range table that is referred to at a time of regular image formation. For example, in the case of a paper sheet classified as "paper type: high-quality paper" and "basis weight: 45 g/m$^2$", "classification No. 1" is selected, and the allowable fixing temperature range is set at 155 to 175° C. In a case where fixing properties can be maintained even when usable toner is at a high temperature (where high-temperature offsetting does not occur), any upper limit value may not be set for the allowable fixing temperature range.

TABLE 1

| | Allowable fixing temperature range | |
|---|---|---|
| Classification No. | Lower limit [° C.] | Upper limit [° C.] |
| 1 | 155 | 175 |
| 2 | 160 | 180 |
| 3 | 165 | 185 |
| 4 | 170 | 190 |
| 5 | 175 | 195 |
| 6 | 180 | 200 |
| 7 | 185 | 205 |
| 8 | 190 | 210 |
| 9 | 195 | 215 |
| 10 | 200 | 220 |

The sheet conveying unit 50 includes a sheet feeding unit 51, a sheet discharging unit 52, a first conveying unit 53, a second conveying unit 54, and the like. Paper sheets (standard paper sheets or special paper sheets) sorted out based on basis weights, sizes, and the like are housed in accordance with predetermined paper types in the three sheet feeder tray units 511 through 513 that constitute the sheet feeding unit 51.

The first conveying unit 53 includes conveyance roller units such as an intermediate conveyance roller unit 531, a loop roller unit 532, and a resist roller unit 533. The first conveying unit 53 conveys a paper sheet supplied from the sheet feeding unit 51 or an external sheet feeder (not shown) to the image forming unit 40 (the secondary transfer unit).

The second conveying unit 54 includes a switchback path 541 and a back surface conveyance path 542 in which conveyance roller units are placed. After conveying a paper sheet to the switchback path 541, the second conveying unit 54 reverses the paper sheet by performing a switchback operation and conveying the paper sheet to the back surface conveyance path 542, and then supplies the paper sheet to the first conveying unit 53 (on the upstream side of the loop roller unit 532).

A paper sheet supplied from the sheet feeding unit 51 or an external sheet feeder (not shown) is conveyed to the image forming unit 40 by the first conveying unit 53. When the paper sheet passes through the secondary transfer nip, the toner images on the intermediate transfer belt 421 are collectively transferred onto one surface (the fixing surface) of the paper sheet through a secondary transfer, and are subjected to a fixing process at the fixing unit 60. The paper sheet having an image formed thereon is then discharged to the outside of the apparatus by the sheet discharging unit 52 including sheet discharging rollers 52*a*. In a case where images are to be formed on both surfaces of a paper sheet, the paper sheet having an image formed on its front surface is sent to the second conveying unit 54, and another image is formed on the back surface of the paper sheet after the paper sheet is turned over.

The image forming apparatus 1 has an adjustment mode in which various adjustments for image formation are performed. In the adjustment mode, users (including servicepersons) can adjust the timing to write an image, the magnification in the sub scanning direction (the sheet conveying direction), the magnification in the main scanning direction (a direction perpendicular to the sheet conveying direction), the amount of correction for correcting an inclination or tilt of paper sheets, beam pitch, density balance, the highest density, and the like.

Figure 5:
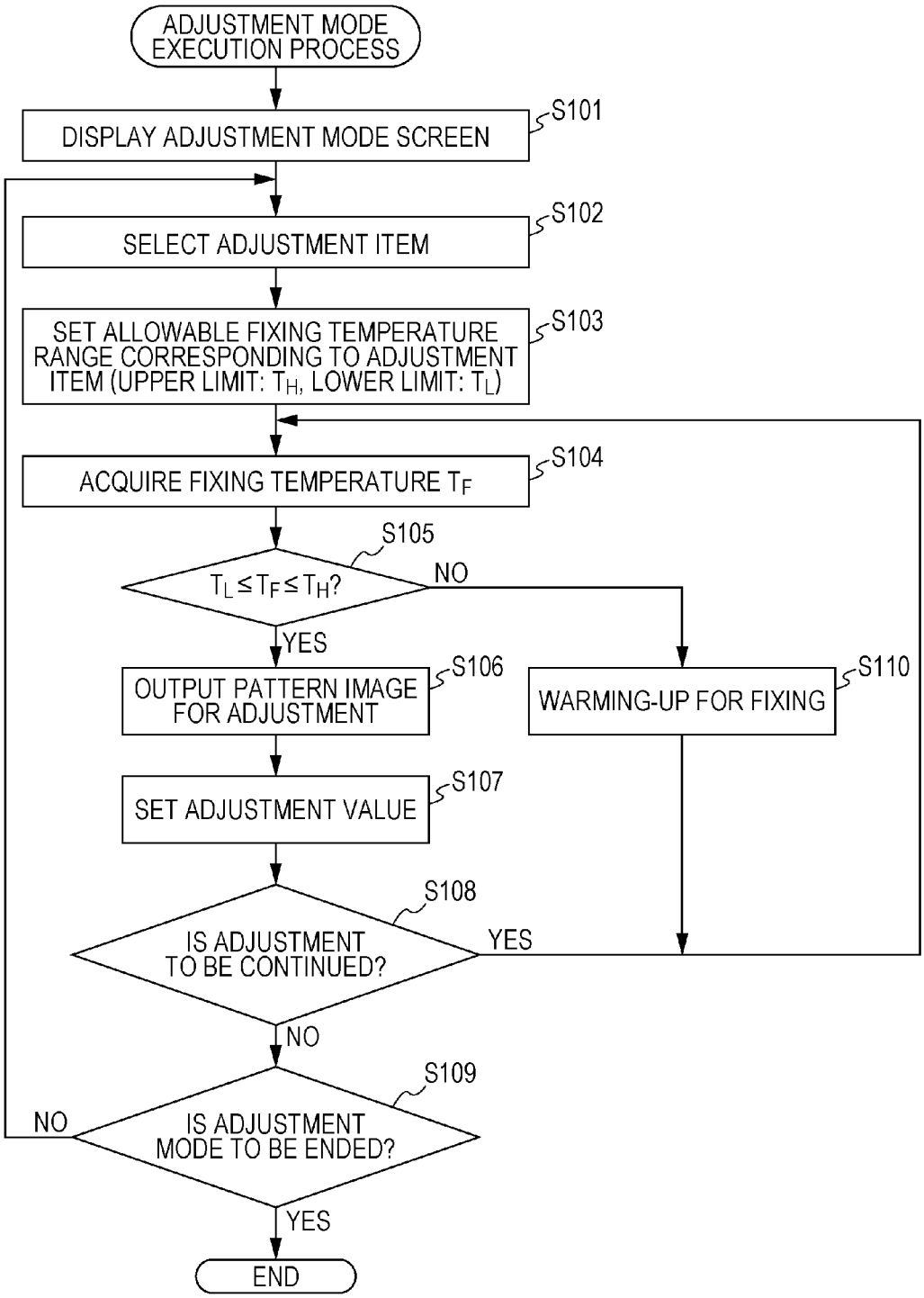
FIG. 5 is a flowchart showing an example of an adjustment mode execution process.

FIG. 5 is a flowchart showing an example of an adjustment mode execution process. The adjustment mode execution process shown in FIG. 5 is realized by the CPU 101 executing a predetermined program stored in the ROM 102 as a user performs an operation to issue an adjustment mode execution instruction through the operation display unit 20, for example.

Figure 6:
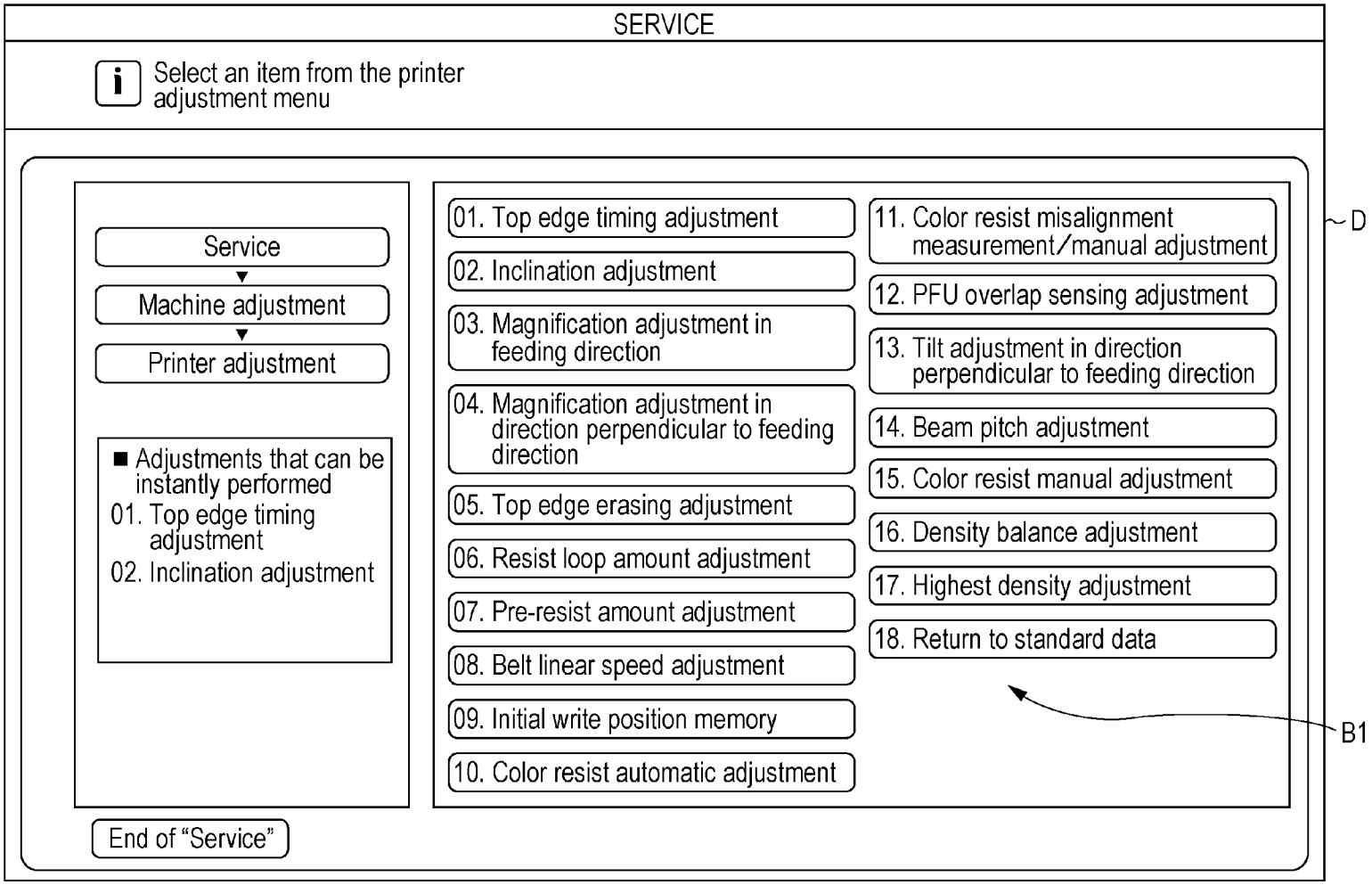
FIG. 6 is a diagram showing an example of an adjustment mode screen.

As shown in FIG. 5, in step S101, the control unit 100 causes the operation display unit 20 to display an adjustment mode screen. FIG. 6 shows an example of the adjustment mode screen. The adjustment mode screen shown in FIG. 6 is a menu screen primarily for a serviceperson to select an adjustment item. The adjustment mode screen D has buttons B1 (18 buttons in FIG. 6) associated with adjustment items. A serviceperson can perform a desired adjustment by selecting one of the adjustment item buttons B1.

Of the adjustment items shown in FIG. 6, "01. top edge timing adjustment", "02. inclination adjustment", "03. magnification adjustment in feeding direction", "04. magnification adjustment in direction perpendicular to feeding direction", "05. top edge erasing adjustment", "08. belt linear speed adjustment", "11. color resist misalignment measurement/manual adjustment", "13. tilt adjustment in direction perpendicular to feeding direction", "14. beam pitch adjustment", "16. density balance adjustment", and "17. highest density adjustment" are performed based on outputs of pattern images for adjustments.

In "01. top edge timing adjustment", a serviceperson checks a top edge timing indicator and inputs an adjustment value based on an output of a pattern image for top edge timing adjustment, so that the position of the top edge of an image on the basis of the top edge of the paper sheet in the sheet feeding direction is adjusted.

In "02. inclination adjustment", a serviceperson checks an inclination of the right and left lines with respect to the center line and inputs an adjustment value based on an output of a pattern image for an inclination adjustment, so that an inclination of an image in the sheet feeding direction is adjusted.

In "03. magnification adjustment in feeding direction" or "04. magnification adjustment in direction perpendicular to feeding direction", a serviceperson checks the magnification in the sheet feeding direction (the sub scanning direction) or in the direction perpendicular to the sheet feeding direction (the main scanning direction) and inputs an adjustment value based on an output of a pattern image for a magnification adjustment, so that the magnification serving as the reference value for a front/back surface adjustment is adjusted.

In "05. top edge erasing adjustment", the amount of white (the amount of the erased portion) in the top edge of the image in the sheet feeding direction is adjusted based on an output of a pattern image for a top edge erasing adjustment.

In "08. belt linear speed adjustment", the linear speed of the intermediate transfer belt 421 is adjusted based on an output of a pattern image for a belt linear speed adjustment. When the magnification in the sub scanning direction changes due to resist roller abrasion or thermal contraction of paper, "03. magnification adjustment in feeding direction" is performed. When the magnification in the sub scanning direction changes for any other reason, "08. belt linear speed adjustment" is performed.

In "13. tilt adjustment in direction perpendicular to feeding direction", a tilt in the direction perpendicular to the sheet feeding direction (image distortion in the main scanning direction) is adjusted based on an output of a pattern image for a tilt adjustment in the direction perpendicular to the sheet feeding direction.

Figure 7:
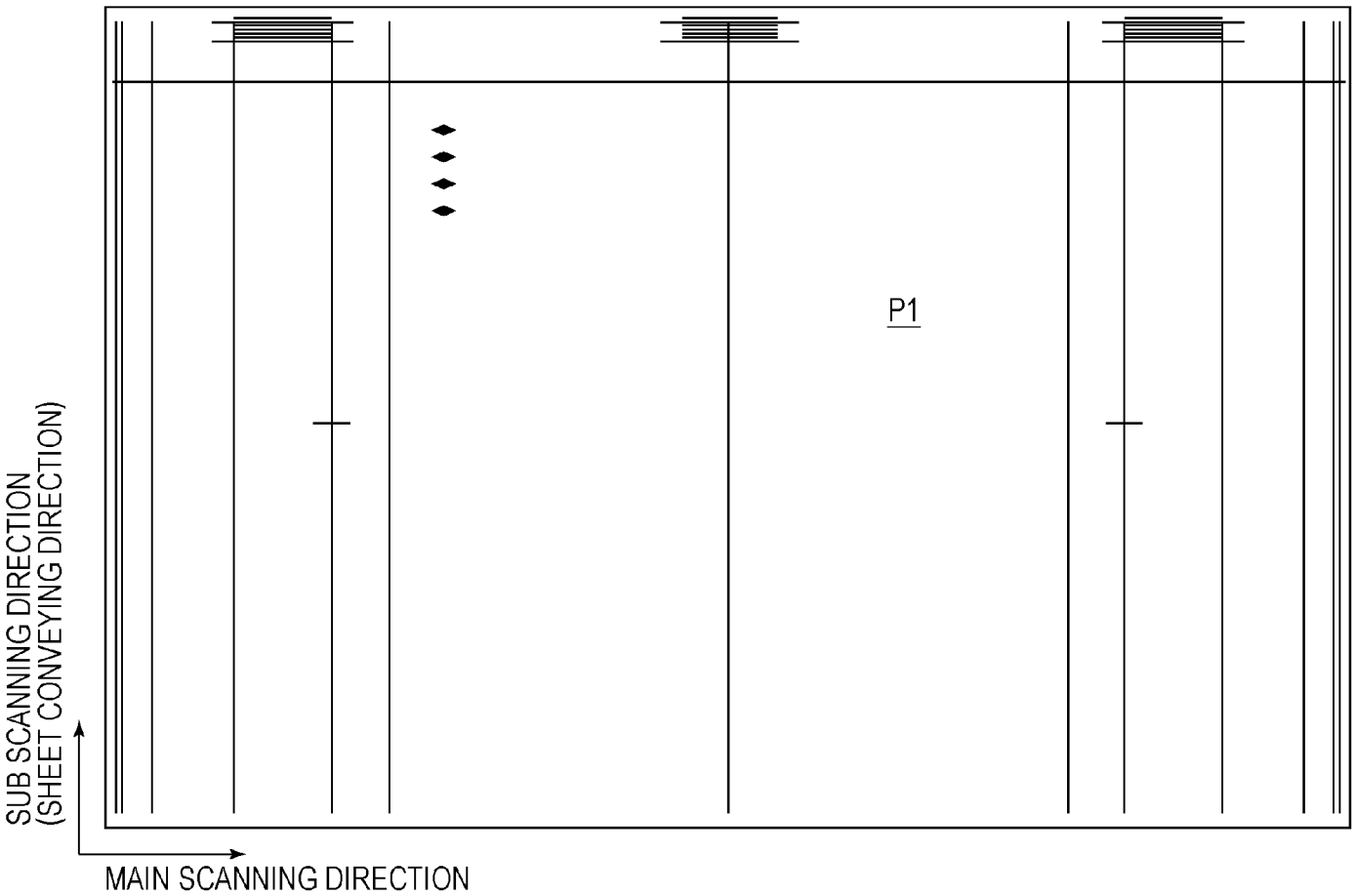
FIG. 7 is an example of a pattern image for adjustment.

For these adjustment items, a pattern image P1 (see FIG. 7) formed with lines drawn at predetermined intervals in the main scanning direction and the sub scanning direction is used, for example.

Figure 8:
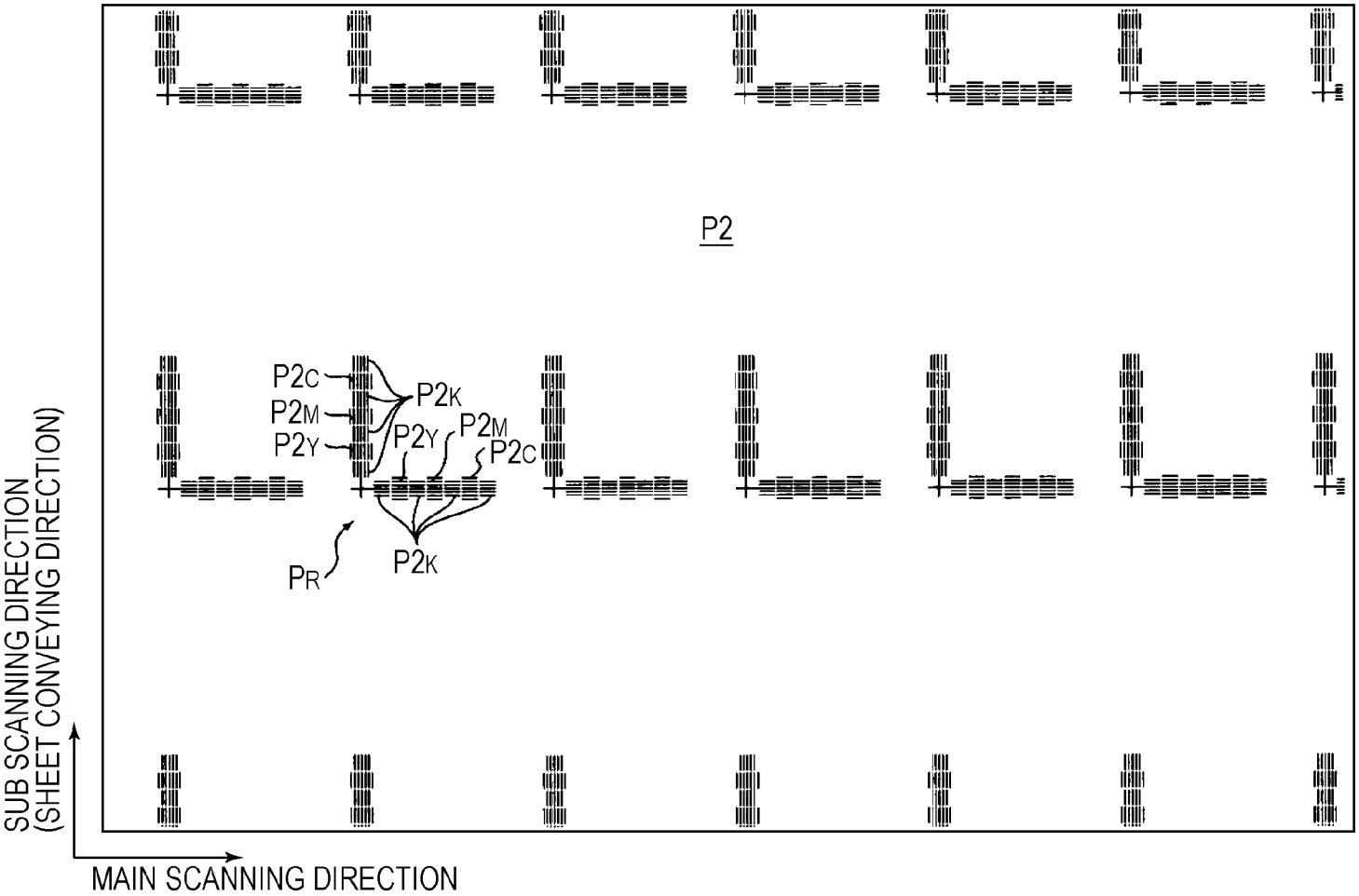
FIG. 8 is another example of a pattern image for adjustment.

In "11. color resist misalignment measurement/manual adjustment", an output pattern image is read by the document image scanning device 12, so that the main scanning directions, the sub scanning directions, the entire magnifications in the main scanning directions, partial magnifications in the main scanning directions, tilts, and amounts of scanning misalignment of line patch images of the Y component, the M component, and the C component are measured with reference to a line patch image of the K component. A serviceperson manually moves an adjustment member (not shown) based on measurement results, and adjusts the partial magnifications in the main scanning direction. For this adjustment item, a pattern image P2 (see FIG. 8) formed with reference patterns $P_R$ placed at predetermined intervals in the main scanning direction and the sub scanning direction is used, for example. Each of the reference patterns $P_R$ is formed by continuously placing line patch images $P2_Y$, $P2_M$, $P2_C$, and $P2_K$ of the respective colors in the main scanning direction and the sub scanning direction. Each of the line patch images $P2_Y$, $P2_M$, $P2_C$, and $P2_K$ is formed with lines drawn at predetermined intervals.

Figure 9:
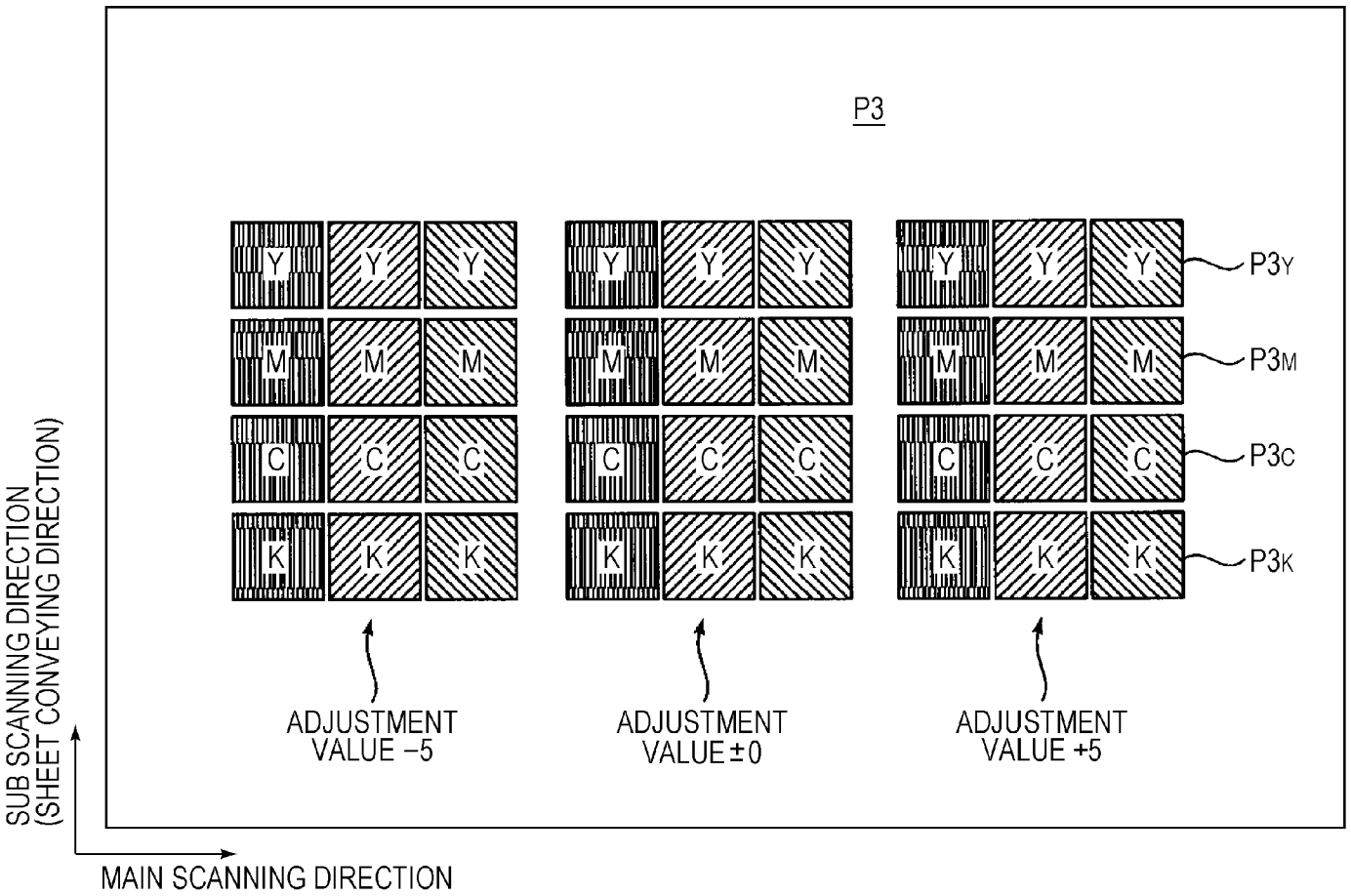
FIG. 9 is yet another example of a pattern image for adjustment.

In "14. beam pitch adjustment", a serviceperson checks misalignment of the beam pitch of each color and inputs an adjustment value based on an output of a pattern image for a beam pitch adjustment, so that the inter-beam pitch of the LDs (Laser Diodes) constituting the exposing device 411 is adjusted. For this adjustment item, a pattern image P3 (see FIG. 9) formed by placing patch images $P3_Y$, $P3_M$, $P3_C$, and $P3_K$ of the respective colors in the main scanning direction in accordance with adjustment values that are set in a stepwise manner is used, for example. Each of the patch images includes two moire patch images and one line patch image.

Although not shown in the drawing, moire adjustment can also be performed by using one patch image (including two moire patch images) of the pattern image P3.

Figure 10:
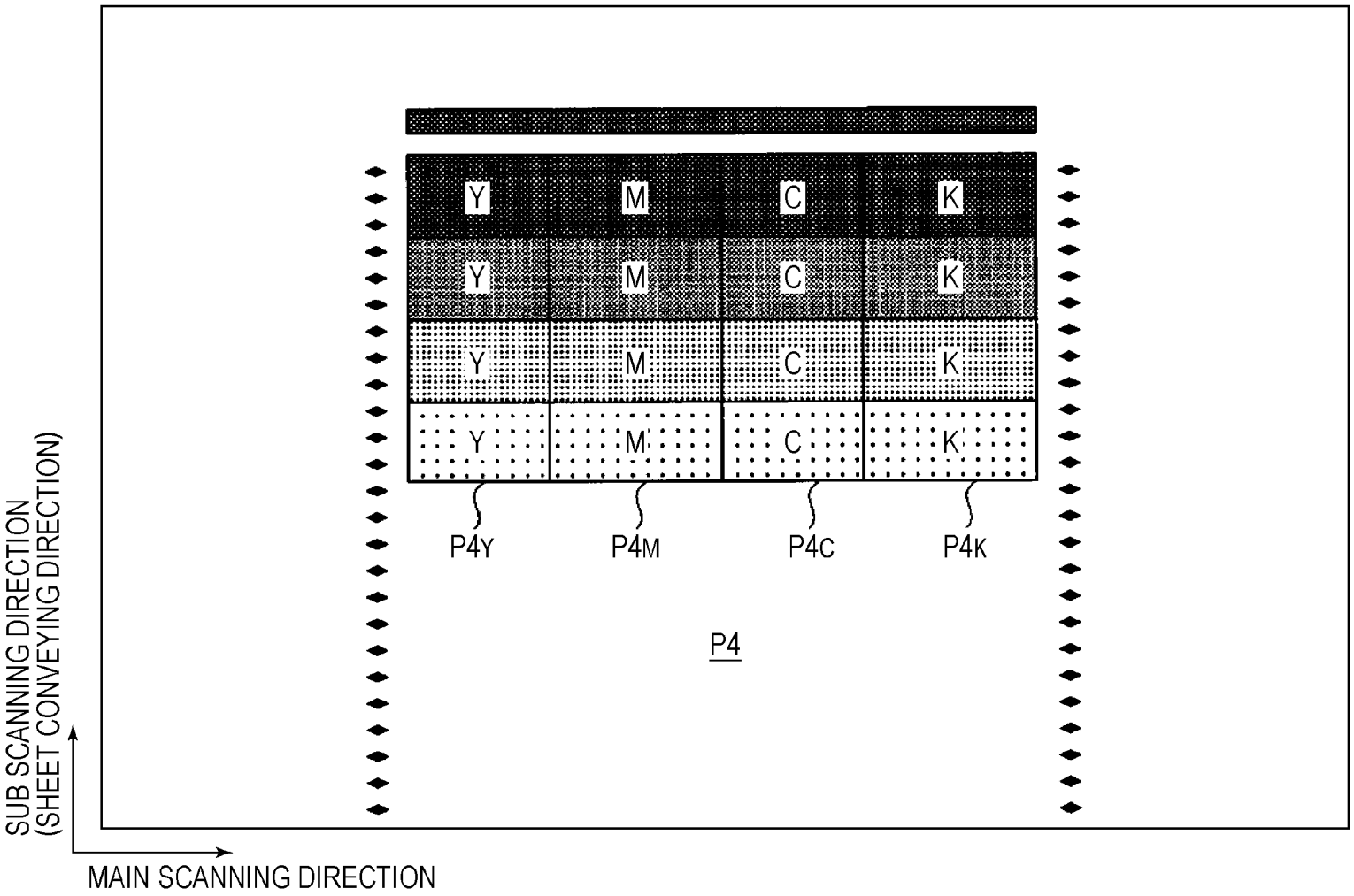
FIG. 10 is still another example of a pattern image for adjustment.

In "16. density balance adjustment", the density balance in the direction perpendicular to the sheet feeding direction is adjusted by registering profiles of results of measurement carried out with a colorimeter (colorimetric data) based on results of an output of a pattern image for a density balance adjustment. For this adjustment item, a pattern image P4 (see FIG. 10) formed by continuously placing patch images $P4_Y$, $P4_M$, $P4_C$, and $P4_K$ of the respective colors in the main scanning direction is used, for example. Each of the patch images $P4_Y$, $P4_M$, $P4_C$, and $P4_K$ contains four image densities in a stepwise manner.

Figure 11:
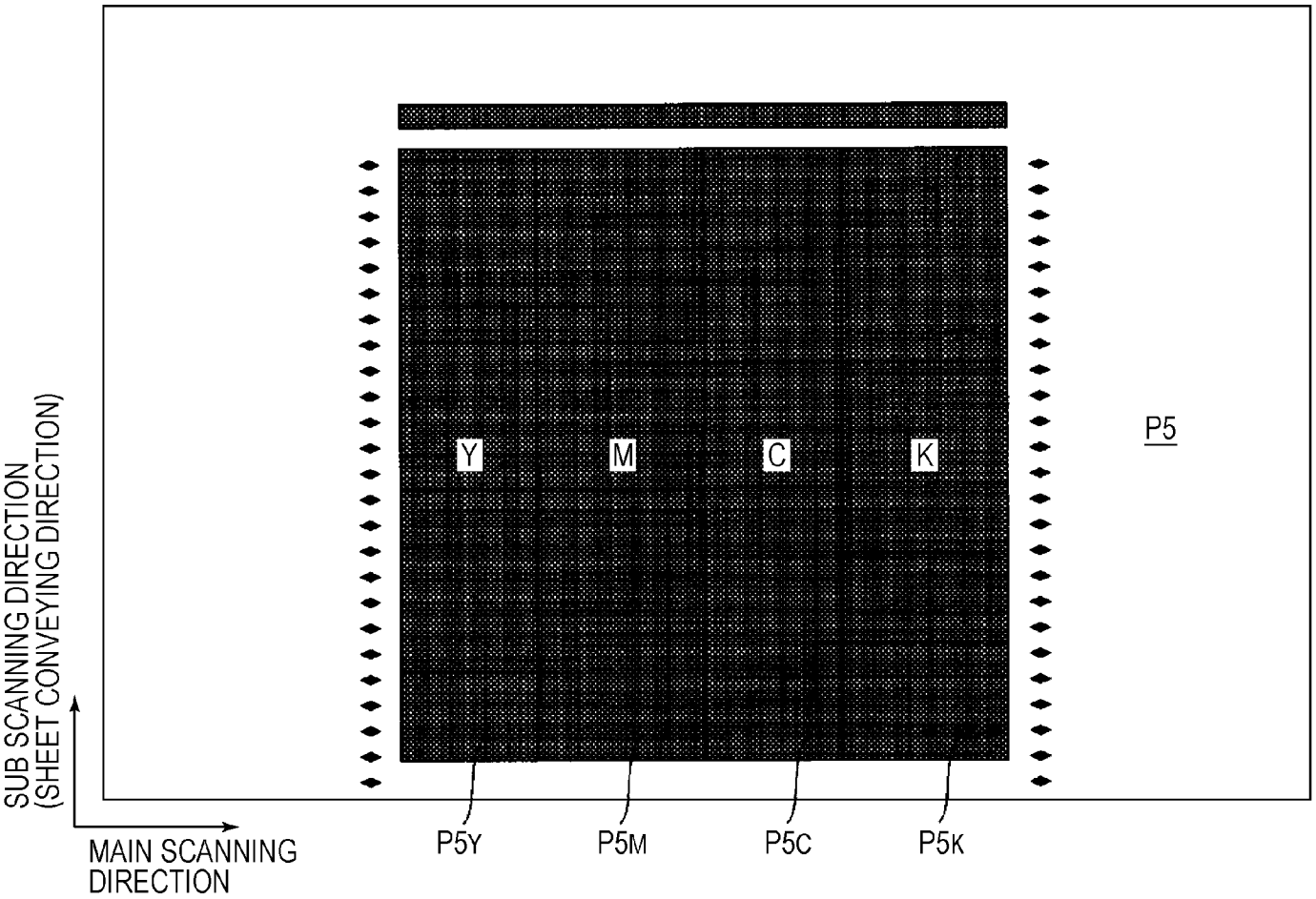
FIG. 11 is yet another example of a pattern image for adjustment.

In "17. highest density adjustment", a serviceperson visually checks an image density and inputs an adjustment value based on an output of a pattern image for a highest density adjustment, so that shades in a highest density image (a solid image) are adjusted. The adjustment value may be automatically set by a colorimeter measuring an image density. For this adjustment item, a pattern image P5 (see FIG. 11) formed by continuously placing patch images $P5_Y$, $P5_M$, $P5_C$, and $P5_K$ of the respective colors of the highest density in the main scanning direction is used, for example.

In step S102 in FIG. 5, the control unit 100 selects an adjustment item to be adjusted based on an adjustment item button operation performed by a serviceperson. After an adjustment item is selected, an adjustment screen (not shown) for the selected adjustment item is displayed. This adjustment screen for the adjustment item includes buttons for the serviceperson to input adjustment values.

In step S103, the control unit 100 refers to an allowable fixing temperature range table, to set the allowable fixing temperature range (from the lower limit $T_L$ to the upper limit $T_H$) corresponding to the selected adjustment item. Allowable fixing temperature range tables are prepared for respective types of paper sheets and respective basis weights, are experimentally determined at the time of manufacture of the image forming apparatus 1, for example, and are stored into the storage unit 72.

Table 2 shows an example of the allowable fixing temperature range table to be referred to in the adjustment mode. The allowable fixing temperature range table shown in Table 2 is the table to be referred to in a case where paper sheets classified as "paper type: high-quality paper" and "basis weight: 45 g/m$^2$" are used.

TABLE 2

| Adjustment item | Allowable fixing temperature range Lower limit [° C.] | Upper limit [° C.] |
|---|---|---|
| 01. Top edge timing adjustment | 140 (−10) | 185 (+10) |
| 02. Inclination adjustment | 145 (−10) | 185 (+10) |
| 03. Magnification adjustment in feeding direction | 145 (−10) | 185 (+10) |
| 11. Color resist misalignment measurement/manual adjustment | 150 (−5) | 180 (+5) |
| 14. Beam pitch adjustment | 148 (−7) | 182 (+7) |
| 16. Density balance adjustment | 155 (±0) | 175 (±0) |
| 17. Highest density adjustment | 155 (±0) | 175 (±0) |
| Regular image formation | 155 | 175 |

Values shown in parentheses indicate differences from regular image formation

Figure 1:
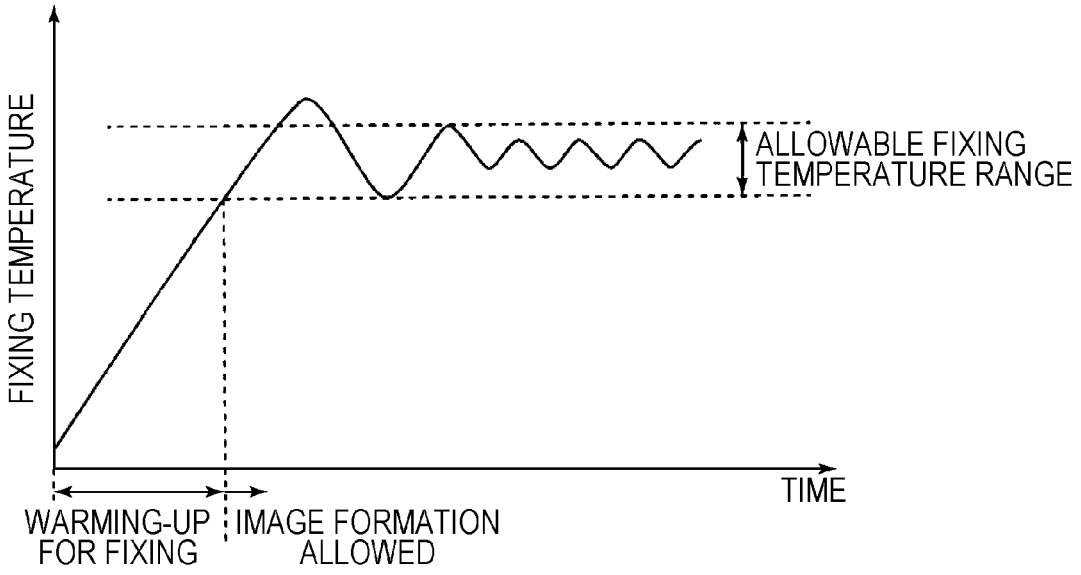
FIG. 1 is a graph showing an allowable fixing temperature range and a warming-up time before fixing.
Figure 2:
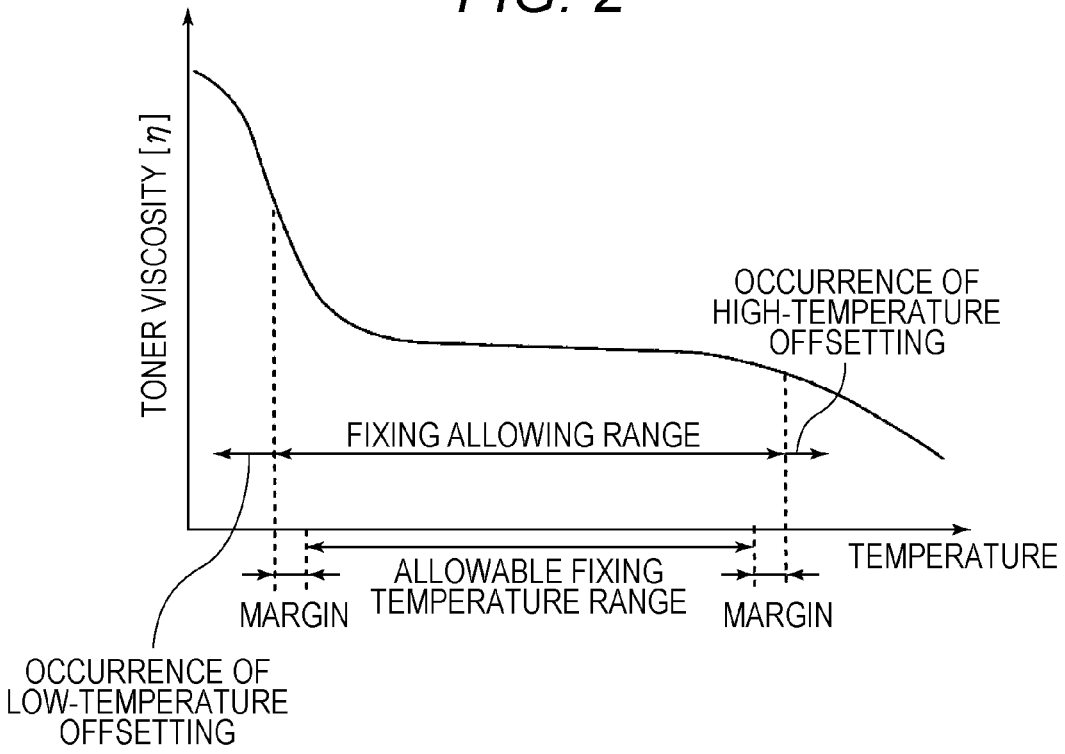
FIG. 2 is a graph showing the temperature-viscosity characteristics of toner.

In "01. top edge timing adjustment", "02. inclination adjustment", "03. magnification adjustment in feeding direction", "11. color resist misalignment measurement/manual adjustment", and "14. beam pitch adjustment", the pattern of a pattern image should be recognized, but the image density in the pattern image is not important. Therefore, fixing properties may not be 100%, as long as the smallest necessary fixing properties are secured in the output pattern image. In this manner, for the adjustment items that do not require 100% fixing properties in an output pattern image, the allowable fixing temperature range can be made wider than that in the case of regular image formation, as shown in Table 2. Since the allowable fixing temperature range for regular image formation is normally set narrower than the fixing allowing range by a predetermined lower margin and a predetermined higher margin (see FIG. 2), the lower limit can be made lower by the lower margin, and the upper limit can be made higher by the upper margin. In this case, neither low-temperature offsetting nor high-temperature offsetting occurs, and the smallest necessary fixing properties can be maintained.

In "11. color resist misalignment measurement/manual adjustment", the pattern image P2 is read by the document image scanning device 12, and therefore, fixing properties are preferably increased by making the allowable fixing temperature range narrower than that in a case where "01. top edge timing adjustment", "02. inclination adjustment", or "03. magnification adjustment in feeding direction" is performed. Also, the amount of toner adhering to the pattern image P3 is apparently larger than the amount of toner adhering to the pattern image P1. Therefore, in "14. beam pitch adjustment", fixing properties are preferably increased by making the allowable fixing temperature range narrower than that in a case where "01. top edge timing adjustment", "02. inclination adjustment", or "03. magnification adjustment in feeding direction" is performed.

Meanwhile, in "16. density balance adjustment" and "17. highest density adjustment", a pattern image as well as an image density needs to be accurately reproduced. Therefore, the same allowable fixing temperature range as that used at a time of regular image formation is set for these adjustment items, as shown in Table 2.

In step S104 in FIG. 5, the control unit 100 acquires the current fixing temperature $T_F$ based on an output signal from the fixing temperature detecting unit 64.

In step S105, the control unit 100 determines whether the fixing temperature $T_F$ is within the allowable fixing temperature range set in step S103. For example, when the image forming apparatus 1 is switched on or when the operation mode is switched from a power saving mode, the fixing temperature $T_F$ is considered to be lower than the lower limit $T_L$ of the allowable fixing temperature range. When the paper to be used in image formation is changed from thick paper to thin paper, or after image formation is performed on a small number of paper sheets (the fixing temperature overshooting), on the other hand, the fixing temperature $T_F$ is considered to be higher than the upper limit $T_H$ of the allowable fixing temperature range. If the control unit 100 determines that the fixing temperature $T_F$ is within the allowable fixing temperature range, the process moves on to step S106. If the control unit 100 determines that the fixing temperature $T_F$ is outside the allowable fixing temperature range, on the other hand, the process moves on to step S110.

In step S106, the control unit 100 causes the corresponding one of the pattern images for adjustment to be output. The pattern images for adjustment are set beforehand for the respective adjustment items (see FIGS. 7 through 11).

In step S107, the control unit 100 sets an adjustment value based on an output of the pattern image for adjustment. This adjustment value is automatically set based on a result of reading of the output pattern image, for example. Alternatively, the adjustment value is manually set based on a button operation performed by the serviceperson at the operation display unit 20, for example.

In step S108, the control unit 100 determines whether to continue to adjust the adjustment item being currently adjusted. This determination is performed based on an operation (a button pressing operation to issue an adjustment ending instruction or an adjustment continuing instruction, for example) performed by the serviceperson at the operation display unit 20. For example, in a case where the serviceperson wishes to check whether the adjustment has been appropriately performed, the adjustment is continued. If the control unit 100 determines to continue the adjustment being currently performed, the process moves on to step S104. If the control unit 100 determines to end the adjustment being currently performed, the process moves on to step S109, and the adjustment mode screen returns to the menu screen D shown in FIG. 6.

In step S109, the control unit 100 determines whether to end the adjustment mode. This determination is performed based on an operation performed by the serviceperson at the operation display unit 20. For example, when a button pressing operation to issue an adjustment mode ending instruction is performed, the adjustment is ended. When a button pressing operation to select a new adjustment item is performed, the adjustment mode is continued. If the control unit 100 determines to end the adjustment mode, the adjustment mode execution process comes to an end. If the control unit 100 determines not to end the adjustment mode, the process moves on to step S102, and an adjustment as to the newly selected adjustment item is started.

If the fixing temperature $T_F$ is determined to be outside the allowable fixing temperature range ("NO" in step S105), the control unit 100 performs warming-up for fixing in step S110. For example, in a case where the current fixing temperature $T_F$ is lower than the lower limit $T_L$ of the set allowable fixing temperature range, the heat source 63 is actuated to start heating the fixing surface side member. Also, in a case where the current fixing temperature $T_F$ is higher than the upper limit $T_H$ of the set allowable fixing temperature range, for example, natural cooling is initiated or a cooling unit (not shown) is actuated to cool down the fixing surface side member. This warming-up for fixing is continued until the fixing temperature $T_F$ is adjusted to be within the allowable fixing temperature range. When the warming-up for fixing is finished, the procedures of step S106 and later are carried out. After the warming-up for fixing is finished, the heat source 63 continues to be controlled to maintain the fixing temperature $T_F$ within the allowable fixing temperature range.

Figure 12:
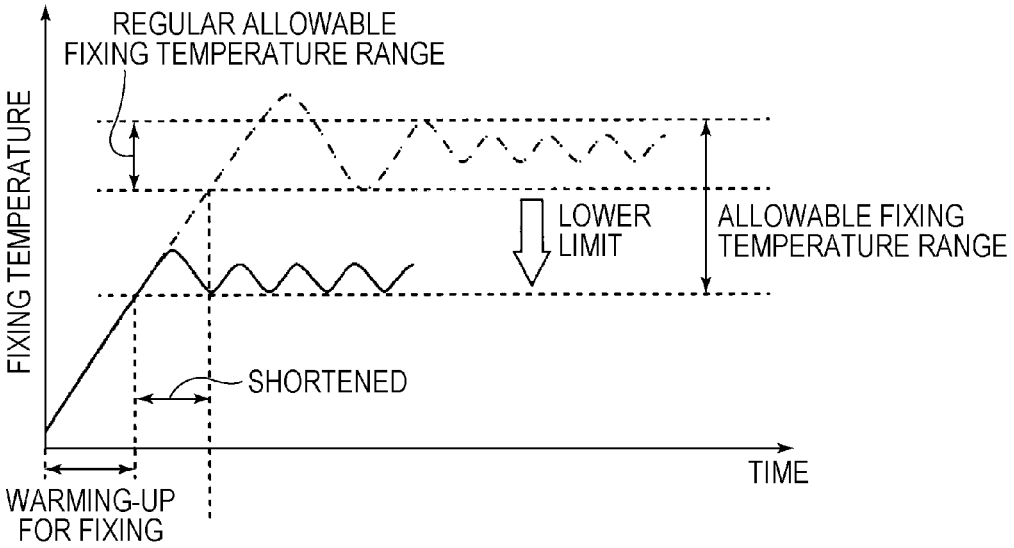
FIG. 12 is a graph showing an example of the warming-up time before fixing in an adjustment mode.

In this embodiment, for the adjustment items such as "01. top edge timing adjustment" that do not require 100% fixing properties in a pattern image to be output, a wider allowable fixing temperature range than that for regular image formation is set. In other words, the lower limit of the allowable fixing temperature range is made lower, and the upper limit is made higher. Accordingly, the warming-up time before fixing in the adjustment mode is dramatically shortened (see FIG. 12). As shown in FIG. 12, when the lower limit of the allowable fixing temperature range is set low, the warming-up time that increases the fixing temperature $T_F$ before fixing can be shortened. When the upper limit of the allowable fixing temperature range is set high, on the other hand, the warming-up time that lowers the fixing temperature $T_F$ before fixing can be shortened.

As described above, the image forming apparatus 1 of this embodiment includes: an image forming unit 40 that forms a toner image on a paper sheet; a fixing unit 60 that fixes the toner image onto the paper sheet; a fixing temperature detecting unit 64 that detects a fixing temperature $T_F$ in the fixing unit 60; and a control unit 100 that allows a fixing operation in the fixing unit 60 only after the fixing temperature $T_F$ is adjusted to be within a predetermined allowable fixing temperature range in a case where the fixing temperature $T_F$ is outside the allowable fixing temperature range.

The control unit 100 sets the allowable fixing temperature range in accordance with the fixing properties required in an output of a corresponding one of the pattern images P1 through P5 in an adjustment mode in which various kinds of adjustments related to image formation can be performed based on an output of the corresponding one of the pattern images P1 through P5 for adjustments (S103 in FIG. 5). Specifically, the control unit 100 sets the allowable fixing temperature range by referring to an allowable fixing temperature range table (Table 2, for example) in which adjustment items are associated with allowable fixing temperature ranges.

In the image forming apparatus 1, the allowable fixing temperature range is set in accordance with the fixing properties required in an output of a corresponding one of the pattern images P1 through P5 used in the adjustment mode. Accordingly, the warming-up time before fixing in the adjustment mode, or more specifically, the warming-up time before fixing in a case where 100% fixing properties are not required in an output of the pattern image, can be shortened. Accordingly, adjustment efficiency dramatically increases, and maintenance costs can be lowered.

Although the present invention made by the present inventor has been described in detail based on an embodiment, the present invention is not limited to the above described embodiment, and changes may be made to the embodiment without departing from the scope of the invention.

For example, when an allowable fixing temperature range is set in the adjustment mode, an allowable fixing temperature range table in which pattern images to be used for various kinds of adjustments are associated with allowable fixing temperature ranges (Table 3, for example) may be referred to. The allowable fixing temperature range table in which adjustment items are associated with allowable fixing temperature ranges, and the allowable fixing temperature range table in which pattern images to be used for various kinds of adjustments are associated with allowable fixing temperature ranges both reflect the fixing properties required in an output of a pattern image.

TABLE 3

| Pattern image | | Allowable fixing temperature range | |
|---|---|---|---|
| | | Lower limit | Upper limit |
| Type | Classification | [° C.] | [° C.] |
| Pattern image P1 (FIG. 7) | Line drawing | 145 (−10) | 185 (+10) |
| Pattern image P2 (FIG. 8) | Others | 150 (−5) | 180 (+5) |
| Pattern image P3 (FIG. 9) | Others | 148 (−7) | 182 (+7) |
| Pattern image P4 (FIG. 10) | For density adjustment | 155 (±0) | 175 (±0) |
| Pattern image P5 (FIG. 11) | For density adjustment | 155 (±0) | 175 (±0) |
| Regular image formation | — | 155 | 175 |

Values shown in parentheses indicate differences from regular image formation

Also, when an allowable fixing temperature range is set in the adjustment mode, the amount of toner consumption or the printing rate at the time of an output of a pattern image for adjustment may be taken into account. When the amount of toner adhering to the pattern image for adjustment is small, the amount of heat required for fixing can be small, and accordingly, the lower limit of the allowable fixing temperature range can be made even lower.

Figure 13:
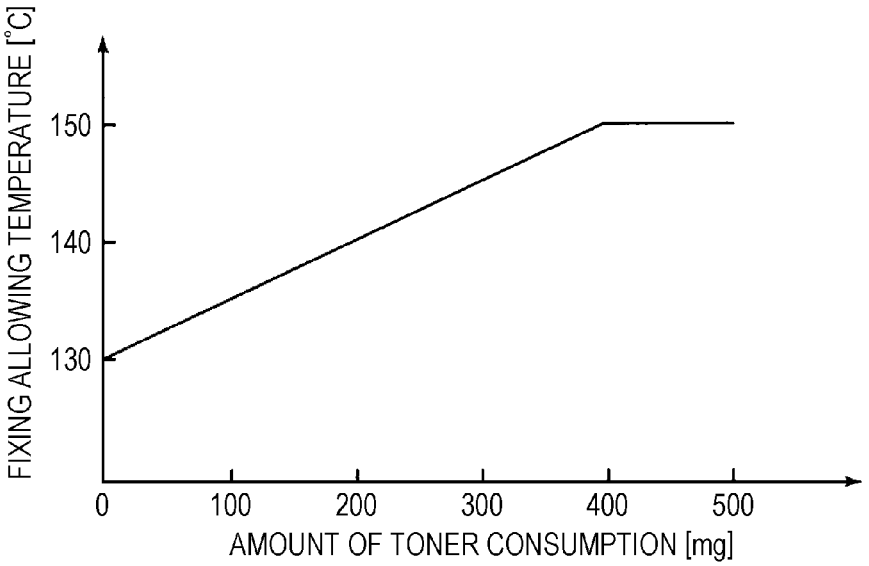
FIG. 13 is a graph showing an example of a relationship between an amount of toner consumption and a fixing allowing temperature.

For example, in a case where the amount of toner consumption and the fixing allowing temperature have the relationship shown in FIG. 13, the allowable fixing temperature range for regular image formation is set regardless of the amount of toner consumption on images, and therefore, the fixing allowing temperature (the lower limit of the allowable fixing temperature range) is 155° C. However, the amount of toner consumption on the pattern image P1, which is a line drawing, is extremely small. If the amount of toner consumption on the pattern image P1 is 10 mg, the fixing allowing temperature is 130° C., as can be seen from FIG. 13. With fixing properties being further taken into account, the lower limit of the allowable fixing temperature range in the adjustment mode can be set at 120° C.

As allowable fixing temperature ranges are set for the pattern images P2 through P5 in the same manner as above, the allowable fixing temperature range table shown in Table 4 can be employed in place of the allowable fixing temperature range table shown in Table 3. In the case of the pattern image P5, the amount of adhering toner is 400 mg or larger, and therefore, the allowable fixing temperature range will not change even if the amount of adhering toner is taken into account.

TABLE 4

| Pattern image | | Allowable fixing temperature range | |
|---|---|---|---|
| Type | Amount of adhering toner (mg) | Lower limit [° C.] | Upper limit [° C.] |
| Pattern image P1 (FIG. 7) | Line drawing | 120 (−35) | 185 (+10) |
| Pattern image P2 (FIG. 8) | Others | 125 (−30) | 180 (+5) |
| Pattern image P3 (FIG. 9) | Others | 128 (−27) | 182 (+7) |
| Pattern image P4 (FIG. 10) | For density adjustment | 145 (−10) | 175 (±0) |
| Pattern image P5 (FIG. 11) | For density adjustment | 155 (±0) | 175 (±0) |
| Regular image formation | — | 155 | 175 |

Values shown in parentheses indicate differences from regular image formation

Furthermore, in the adjustment mode, the current fixing temperature $T_F$ may be compared with the allowable fixing temperature range for each adjustment item, and the operation display unit 20 (the notifying unit) may indicate the adjustment item that can be instantly adjusted (see FIG. 6). Accordingly, a serviceperson can be informed of the adjustment item that can be instantly adjusted, and the adjustment efficiency becomes even higher.

Although the adjustment items that can be adjusted in the adjustment mode are adjustment items related to image formation in the image forming apparatus 1 in the above embodiment, the adjustment items that can be adjusted in the adjustment mode include adjustments to be performed in a postprocessing apparatus that performs postprocessing (such as a punching process or a stapling process) on paper sheets on which images have been formed by the image forming apparatus 1. For example, the adjustments to be performed in a postprocessing apparatus include "punch adjustment" for correcting misalignment of the positions of punch holes based on an output of a pattern image, "staple interval adjustment" for adjusting staple intervals based on an output of a pattern image, "folding position adjustment" for adjusting a folding position based on an output of a pattern image, and the like. For these adjustment items, a line pattern image formed by adding punch hole positions, staple positions, and a line indicating a folding line to the pattern image P1 shown in FIG. 6 is used. Like the allowable fixing temperature range for the adjustment item for which the pattern image P1 is used, the allowable fixing temperature range can be made wider than that for regular image formation, and accordingly, the warming-up time before fixing can be shortened.

The embodiments disclosed in this specification are merely examples in all aspects, and should be construed as non-restrictive ones. The scope of the present invention is shown not by the above description but by the claims, and it should be understood that equivalents of the claimed inventions and all modifications thereof are incorporated herein.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming unit configured to form a toner image on a paper sheet;

a fixing unit configured to fix the toner image onto the paper sheet;

a fixing temperature detector configured to detect a fixing temperature in the fixing unit; and a processor configured to determine whether the fixing temperature is within a predetermined allowable fixing temperature range and, when the fixing temperature is determined to be outside the allowable fixing temperature range, to allow a fixing operation in the fixing unit only after the fixing temperature is adjusted to be within the allowable fixing temperature range, wherein the processor sets the allowable fixing temperature range in accordance with fixing properties required in an output of an adjustment pattern image in an adjustment mode in which various kinds of adjustments related to image formation can be performed based on an output of the adjustment pattern image, wherein the processor is configured to control the image forming unit to form different adjustment pattern images in accordance with adjustment items which are adjustable in the adjustment mode, the adjustment items including (i) a first adjustment item that requires an adjustment pattern image for which a fixing property the same as that of regular image formation is required, and (ii) a second adjustment item that requires an adjustment pattern image for which the fixing property the same as that of the regular image formation is not required, wherein the processor sets the allowable fixing temperature range for the first adjustment item to be the same as a range of the regular image formation, and sets the allowable fixing temperature range for the second adjustment item to be wider than the range of the regular image formation, and wherein the adjustment pattern image is different from an image formed by the regular image formation.

2. The image forming apparatus according to claim 1, wherein the processor sets the allowable fixing temperature range by referring to an allowable fixing temperature range table in which the adjustment items are associated with allowable fixing temperature ranges.

3. The image forming apparatus according to claim 1, wherein the processor sets the allowable fixing temperature range by referring to an allowable fixing temperature range table in which a plurality of pattern images to be used for various kinds of adjustments are associated with allowable fixing temperature ranges.

4. The image forming apparatus according to claim 1, wherein the processor sets the allowable fixing temperature range based on an amount of toner consumption or a printing rate at a time of the output of the pattern image for adjustment.

5. The image forming apparatus according to claim 1, further comprising a notifying unit configured to present information to a user, wherein the processor compares a current fixing temperature detected by the fixing temperature detector with the allowable fixing temperature range, and causes the notifying unit to notify the user of an adjustment item, from among the adjustment items, that can be instantly adjusted.

* * * * *